US011186882B2

(12) United States Patent
Karlen et al.

(10) Patent No.: US 11,186,882 B2
(45) Date of Patent: Nov. 30, 2021

(54) METHOD TO LIQUEFY BIOMASS

(71) Applicant: Wisconsin Alumni Research Foundation, Madison, WI (US)

(72) Inventors: Steven D. Karlen, Madison, WI (US); John Ralph, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 212 days.

(21) Appl. No.: 16/519,492

(22) Filed: Jul. 23, 2019

(65) Prior Publication Data

US 2020/0056252 A1 Feb. 20, 2020

Related U.S. Application Data

(60) Provisional application No. 62/718,568, filed on Aug. 14, 2018.

(51) Int. Cl.
*C13K 13/00* (2006.01)

(52) U.S. Cl.
CPC ..... *C13K 13/007* (2013.01)

(58) Field of Classification Search
None
See application file for complete search history.

(56) References Cited

U.S. PATENT DOCUMENTS 7,880,049 B2 * 2/2011 Dumesic ..... C07D 307/42 585/733
2010/0307050 A1 * 12/2010 Sen ..... C10L 1/1855 44/352

OTHER PUBLICATIONS

O'Hara (Year: 2016).*

* cited by examiner

*Primary Examiner* — Stefanie J Cohen
(74) *Attorney, Agent, or Firm* — Joseph T. Leone, Esq.; DeWitt LLP

(57) ABSTRACT

A method of liquefying biomass. The method includes the steps of contacting biomass with a solution comprising an acyl halide and an acid; and then contacting the biomass with a reductant.

35 Claims, 10 Drawing Sheets

FEEDSTOCK

LOW-TEMPERATURE LIQUEFACTION

REDUCTIVE DEPOLYMERIZATION

SEPARATION

METHOD TO LIQUEFY BIOMASS

CROSS-REFERENCE TO RELATED APPLICATIONS

Priority is hereby claimed to provisional application Ser. No. 62/718,568, filed Aug. 14, 2018, which is incorporated herein by reference.

FEDERAL FUNDING STATEMENT

This invention was made with government support under DE-SC0006930 and DE-SC0018409 awarded by the US Department of Energy. The government has certain rights in the invention.

BACKGROUND

Conversion of renewable, solid biomass into value-added chemicals or liquid feedstocks is a challenge due to the complexity, stability, and variety of compounds found in biomass. Most biomass processing techniques require harsh chemical conditions and high temperatures (for example, Kraft pulping, syngas production, and biochar production). Ionic liquids have been used to liquefy solid biomass at room temperature. However, ionic liquids are expensive, must be recovered, and can adversely impact downstream processing of the biomass.

Lignin, for example, is a complex macromolecule that occurs in the cell wall of plants and is composed of various phenolic monomer building blocks such as p-coumaryl alcohol, coniferyl alcohol, and sinapyl alcohol. Lignin is incorporated into the plant cell wall during the growth of plants. About 20% to 30% of the dry matter of lignified plants comprises lignin. In addition to cellulose and chitin, lignin is one of the most abundant organic compounds on Earth and is the largest sustainable source of aromatics on the planet.

Lignin and lignin-containing substances such as alkali lignin, lignin sulfate, or lignosulfonate occur in large amounts as byproducts of various industrial processes, such as pulp and paper manufacturing. The total production of lignin-containing substances is estimated at about 20 billion tons per year. Lignin is therefore a very valuable raw material. Most of it, however, is simply burned for its energy content or landfilled. Some lignin is used in value-added processes. For example, alkali lignin, which can be produced by alkali treatment of the black liquor arising in paper manufacture, is used in North America as a binder for particle boards based on wood and cellulose, as a dispersant, as an agent for clarification of sugar solutions, and as a stabilizer for asphalt emulsions and foam.

Because lignin is rich in aromatics, lignin can potentially serve as a source for a number of valuable aromatic polymers, oligomers, and monomers. However, lignin is notoriously difficult to liquefy, selectively modify, or break down into simpler compounds. Thus, there remains a long-felt and unmet need for a process to liquefy biomass at lower temperatures and gentler reaction conditions.

SUMMARY

Conversion of biomass into process sable solution streams applicable to the up-conversion of the material for different uses is a significant challenge. As noted above, conventional techniques for biomass processing require harsh chemical conditions, high temperatures, mechanical preprocessing (chipping, grinding, and milling), and several different post-treatment steps.

Disclosed herein is a method for the liquefaction of biomass at near-ambient temperature with low-cost solvents and reagents. The method does not require any mechanical pretreatment of the biomass (beyond coarse chipping for the reactor) and is plant-biomass-type agnostic. That is, the disclosed method works efficiently and to the same extent regardless of feedstock: softwoods, hardwoods/dicots, grasses, etc. The process comprises of an acidic derivatization step that liquefies and partially deconstructs the biomass, followed by further deconstruction of the soluble polymer chains (i.e., in homogeneous solution) into a mixture of products under reductive basic conditions. Combined, this two-step procedure produces a mixture of sugars, phenolics, and aliphatic products that can be further processed into an array of products.

Disclosed herein is a method of liquefying and deconstructing biomass. The method comprises contacting biomass with a solution comprising an acyl halide and an acid; and then contacting the biomass with a reductant.

Another version of the method comprises contacting the biomass with a reductant that comprises a sulfide.

In another version, the method comprises contacting the biomass with a reductant that comprises of an alkali metal sulfide salt.

In yet another version, the method comprises contacting the biomass with a reductant that comprises sodium sulfide and/or potassium sulfide.

Still another version of the method is a method of liquefying biomass comprising contacting biomass with a solution comprising of an acyl halide and a carboxylic acid; and then contacting the biomass with a reductant. Here, the method may comprise contacting the biomass with a reductant that comprises a sulfide. The method may also comprise contacting the biomass with a reductant that comprises an alkali metal sulfide salt, such as, but not limited to, sodium sulfide and/or potassium sulfide.

In yet another version, the method comprises contacting biomass with an aqueous solution comprising an acyl bromide and a carboxylic acid; and then contacting the biomass with a reductant. The method may comprise contacting the biomass with a reductant that comprises a sulfide. Alternatively, the method may also comprise contacting the biomass with a reductant that comprises an alkali metal sulfide salt, such as, but not limited to, sodium sulfide and/or potassium sulfide.

In another version, the method comprises contacting biomass with a solution comprising acetyl bromide and acetic acid; and then contacting the biomass with a reductant. As in other versions of the method, the method may comprise contacting the biomass with a reductant that comprises a sulfide. Alternatively, the method may also comprise contacting the biomass with a reductant that comprises an alkali metal sulfide salt, such as, but not limited to, sodium sulfide and/or potassium sulfide.

Treating biomass with an acyl halide, such as (but not limited to) acetyl bromide, yields a solubilized, halogen-derivatized lignin that is soluble in common organic solvents (e.g., ethyl acetate, tetrahydrofuran, and 1,4-dioxane). The halogen-derivatized lignin is effectively activated for facile degradation under reducing conditions. The solution is then treated with one or more reducing agents at a temperature far lower than that required for kraft pulping. That is, the delignification step of the kraft pulping process requires digesting the nascent pulp under alkaline conditions for several hours at a temperature of at least 170° C., and conventionally at a temperature of from 170° C. to 176° C. (338° F. to 349° F.). Under these conditions lignin and hemicelluloses degrade to give fragments that are soluble in the strongly basic liquid. In contrast, in all versions of the present method, all steps are conducted at a temperature of about 100° C. or less, alternatively at a temperature of about 75° C. or less, and alternatively at a temperature of about 50° C. or less, and alternatively at room temperature (20-25° C.).

The use of sodium sulfide ($Na_2S$) to degrade lignin has a long history as the basis of kraft pulping (where the active reagent is actually the hydrosulfide ion, $HS^-$). The present method, however, is distinctly different because the kraft pulping process requires temperatures of ~170° C. to cleave the lignin. Moreover, cleavage of lignin in the kraft process is by an entirely different mechanism than that involved in the present method. In the present method, the first step involves halogenation of the lignin present in the biomass. This effectively activates the lignin so that it can be cleaved in the second, reducing step, at much lower temperatures. This saves a tremendous amount of energy and equipment costs as compared to convention kraft pulping.

Additionally, there is no need to remove the acyl halide from the reaction solution prior to adding the reductant in the second step.

The resulting product mixture comprises a value-added mix of sugars, polymers, oligomers, and small molecules.

BRIEF DESCRIPTION OF THE DRAWINGS

FIG. 2A is a photo of the feedstock, which may be biomass of any description (e.g., wood chips, ground material, isolated lignins/pulp, etc.). FIG. 2B is a series of photos showing low-temperature liquefaction. Here, solubilization was performed at 50° C. Solubilization may also be performed at room temperature, but the reaction is slower at lower temperatures. FIG. 2C is a series of photos showing reductive depolymerization of the solubilized biomass from FIG. 2B. In this example, sodium sulfide was added directly to the acetic acid solubilization solution. FIG. 2D is a photo of the separated product mix. Ethyl acetate and lignin are in the top fraction; water and sugars are in the bottom fraction.

DETAILED DESCRIPTION

Abbreviations and Definitions

Figure 1A:
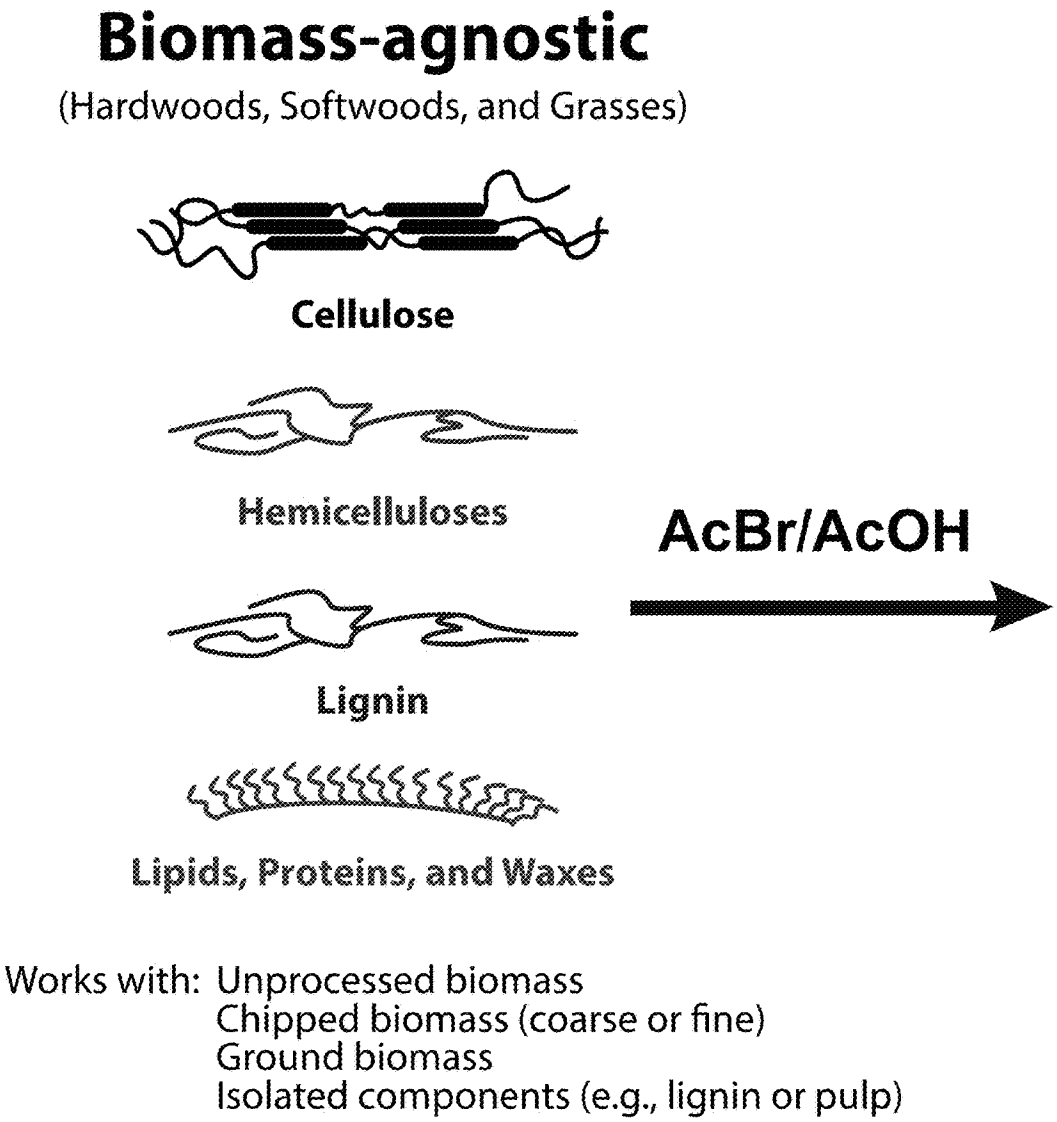
FIGS. 1A, 1B, and 1C taken together constitute a schematic diagram illustrating the method disclosed and claimed herein.

"Acyl halide" refers to a compound of the formula R—(C═O)—X, wherein R is a substituted or unsubstituted alkyl, alkenyl, alkynyl, or aryl (e.g., substituted or unsubstituted phenyl, benzyl, and the like), and X is a halide—i.e., F, Cl, Br, or I.

The term "alkyl," by itself or as part of another substituent, means, unless otherwise stated, a fully saturated, straight, branched chain, or cyclic hydrocarbon radical, or combination thereof, and can include di- and multi-valent radicals, having the number of carbon atoms designated (e.g., $C_1$-$C_{10}$ means from one to ten carbon atoms, inclusive). Examples of alkyl groups include, without limitation, methyl, ethyl, n-propyl, isopropyl, n-butyl, t-butyl, isobutyl, sec-butyl, cyclohexyl, (cyclohexyl)ethyl, cyclopropylmethyl, and homologs, and isomers thereof, for example, n-pentyl, n-hexyl, n-heptyl, n-octyl, and the like.

The term "alkenyl" means an alkyl group as defined above containing one or more double bonds. Examples of alkenyl groups include vinyl, 2-propenyl, crotyl, 2-isopentenyl, 2-(butadienyl), 2,4-pentadienyl, 3-(1,4-pentadienyl), etc., and higher homologs and isomers.

The term "alkynyl" means an alkyl or alkenyl group as defined above containing one or more triple bonds. Examples of alkynyl groups include ethynyl, 1- and 3-propynyl, 3-butynyl, and the like, including higher homologs and isomers.

"Aryl" refers to an aromatic hydrocarbon group derived from the removal of one hydrogen atom from a single carbon atom of a parent aromatic ring system. The radical attachment site can be at a saturated or unsaturated carbon atom of the parent ring system. The aryl group can have from 6 to about 20 carbon atoms. The aryl group can have a single ring (e.g., phenyl) or multiple condensed (fused) rings, wherein at least one ring is aromatic (e.g., naphthyl, dihydrophenanthrenyl, fluorenyl, or anthryl). Typical aryl groups include, but are not limited to, radicals derived from benzene, naphthalene, anthracene, biphenyl, and the like. The aryl can be unsubstituted or optionally substituted, as described for alkyl groups.

"DFRC" means Derivatization Followed by Reductive Cleavage. The DFRC method is a degradation procedure that produces analyzable monomers and dimers by cleaving alpha- and beta-ethers in lignins. See U.S. Dairy Forage Research Center 1998 Research Summaries. U.S. Department of Agriculture, Agricultural Research Service, pp. 48-50. See also Appendix A, attached hereto and incorporated herein.

"GC" means gas chromatography.

"GPC" means gel-permeation chromatography.

"Reductant" is used synonymously with "reducing agent" and refers to any element or compound capable of reducing lignin found in biomass. A reductant is thus any agent that loses one or more electrons to another chemical species (in this case lignin) in a redox reaction. The reductant itself is thus oxidized in the reaction. The capacity of any reductant to drive reduction of another chemical species is measured by the reductant's standard reduction potential in volts. A more negative value for standard reduction potential indicates a reductant's greater capacity to reduce another species. Preferred reductants are those that yield a hydrogen sulfide anion ($HS^-$) and/or a sulfide ion ($S^{-2}$) when placed into aqueous solution. Two-electron reductants are preferred, but not required. Thus, "reductant" includes, but is not limited to dihydrogen sulfide ($H_2S$) sodium sulfide, potassium sulfide, magnesium sulfide, transition metal sulfides, and the like. Alkali metal sulfide salts are generally preferred because of their high solubility in water.

"S/G-lignin" refers to lignin containing syringyl (S) and guaiacyl (G) units derived from the monomers sinapyl and coniferyl alcohols (as in hardwoods/dicots and monocots). "S/G+pCA-lignin" refers to S/G-lignin as defined herein in which at least a portion of the lignin is acylated with p-coumarates (as in all monocots). "S/G+pBA-lignin refers to S/G-lignin as defined herein in which at least a portion of the lignin includes p-hydroxybenzoates (as in palm, willow, and aspen/poplar).

The term "substituted" indicates that one or more hydrogen atoms on the group indicated in the expression using "substituted" is replaced with a "substituent." The substituent can be one of a selection of indicated groups, or it can be a suitable group known to those of skill in the art, provided that the substituted atom's normal valency is not exceeded and that the substitution results in a stable compound. Suitable substituent groups include, e.g., alkyl, alkenyl, alkynyl, alkoxy, halo, haloalkyl, hydroxy, hydroxyalkyl, aryl, aroyl, (aryl)alkyl (e.g., benzyl or phenylethyl), heteroaryl, heterocycle, cycloalkyl, alkanoyl, alkoxycarbonyl, amino, alkylamino, dialkylamino, trifluoromethyl, trifluoromethoxy, trifluoromethylthio, difluoromethyl, acylamino, nitro, carboxy, carboxyalkyl, keto, thioxo, alkylthio, alkylsulfinyl, alkylsulfonyl, arylsulfinyl, arylsulfonyl, heteroarylsulfinyl, heteroarylsulfonyl, heterocyclesulfinyl, heterocyclesulfonyl, phosphate, sulfate, hydroxyl amine, hydroxyl(alkyl)amine, and cyano. Additionally, suitable substituent groups can be, e.g., —X, —R, —O—, —OR, —SR, —S—, —$NR_2$, —$NR_3$, =NR, —$CX_3$, —CN, —OCN, —SCN, —N=C=O, —NCS, —NO, —$NO_2$, =$N_2$, —$N_3$, —NC(=O)R, —C(=O)R, —C(=O)NRR, —S(=O)$_2$O—, —S(=O)$_2$OH, —S(=O)$_2$R, —OS(=O)$_2$OR, —S(=O)$_2$NR, —S(=O)R, —OP(=O)O$_2$RR, —P(=O)O$_2$RR, —P(=O)(O—)$_2$, —P(=O)(OH)$_2$, —C(=O)R, —C(=O)X, —C(S)R, —C(O)OR, —C(O)O—, —C(S)OR, —C(O)SR, —C(S)SR, —C(O)NRR, —C(S)NRR, or —C(NR)NRR, where each X is independently a halogen ("halo"): F, Cl, Br, or I; and each R is independently H, alkyl, aryl, (aryl)alkyl (e.g., benzyl), heteroaryl, (heteroaryl)alkyl, heterocycle, heterocycle(alkyl), or a protecting group. As would be readily understood by one skilled in the art, when a substituent is keto (=O) or thioxo (=S), or the like, then two hydrogen atoms on the substituted atom are replaced.

Numerical ranges as used herein are intended to include every number and subset of numbers contained within that range, whether specifically disclosed or not. Further, these numerical ranges should be construed as providing support for a claim directed to any number or subset of numbers in that range. For example, a disclosure of from 1 to 10 should be construed as supporting a range of from 2 to 8, from 3 to 7, 5, 6, from 1 to 9, from 3.6 to 4.6, from 3.5 to 9.9, and so forth.

All references to singular characteristics or limitations of the present invention shall include the corresponding plural characteristic or limitation, and vice-versa, unless otherwise specified or clearly implied to the contrary by the context in which the reference is made. The indefinite articles "a" and "an" mean "one or more" unless specifically noted otherwise.

All combinations of method or process steps as used herein can be performed in any order, unless otherwise specified or clearly implied to the contrary by the context in which the referenced combination is made.

The methods of the present invention can comprise, consist of, or consist essentially of the essential elements and limitations of the method described herein, as well as any additional or optional ingredients, components, or limitations described herein or otherwise useful in synthetic organic chemistry.

The Method:

At its heart, the method is a one-pot, two-step approach wherein biomass of any description is treated with an acyl halide in a solvent (e.g., acetic acid) at a temperature of about 100° C. or less. To this solution is then added a reductant, which functions both to digest the pre-treated biomass and to neutralize (in whole or in part) the acid used in the first step. As noted, it is preferred that both steps be performed at a temperature of 100° C. or less, preferably 75° C. or less, and more preferably still 50° C. or less. Both steps of the reaction are preferably performed at a temperature between about 20° C. and about 100° C., or alternatively between about 20° C. and about 75° C., or alternatively between about 20° C. and about 50° C.

This reaction has been tested on a variety of ground biomass (cedar, oil palm empty fruit bunches, eucalyptus, maple, and *Miscanthus*) and rough-chipped pine, poplar, and corn stover. They all yielded a liquefied product mixture containing different proportions of lignin monomers and oligomers, other small molecules, and polysaccharide monomers, oligomers and likely crystalline cellulose.

Figure 1B:
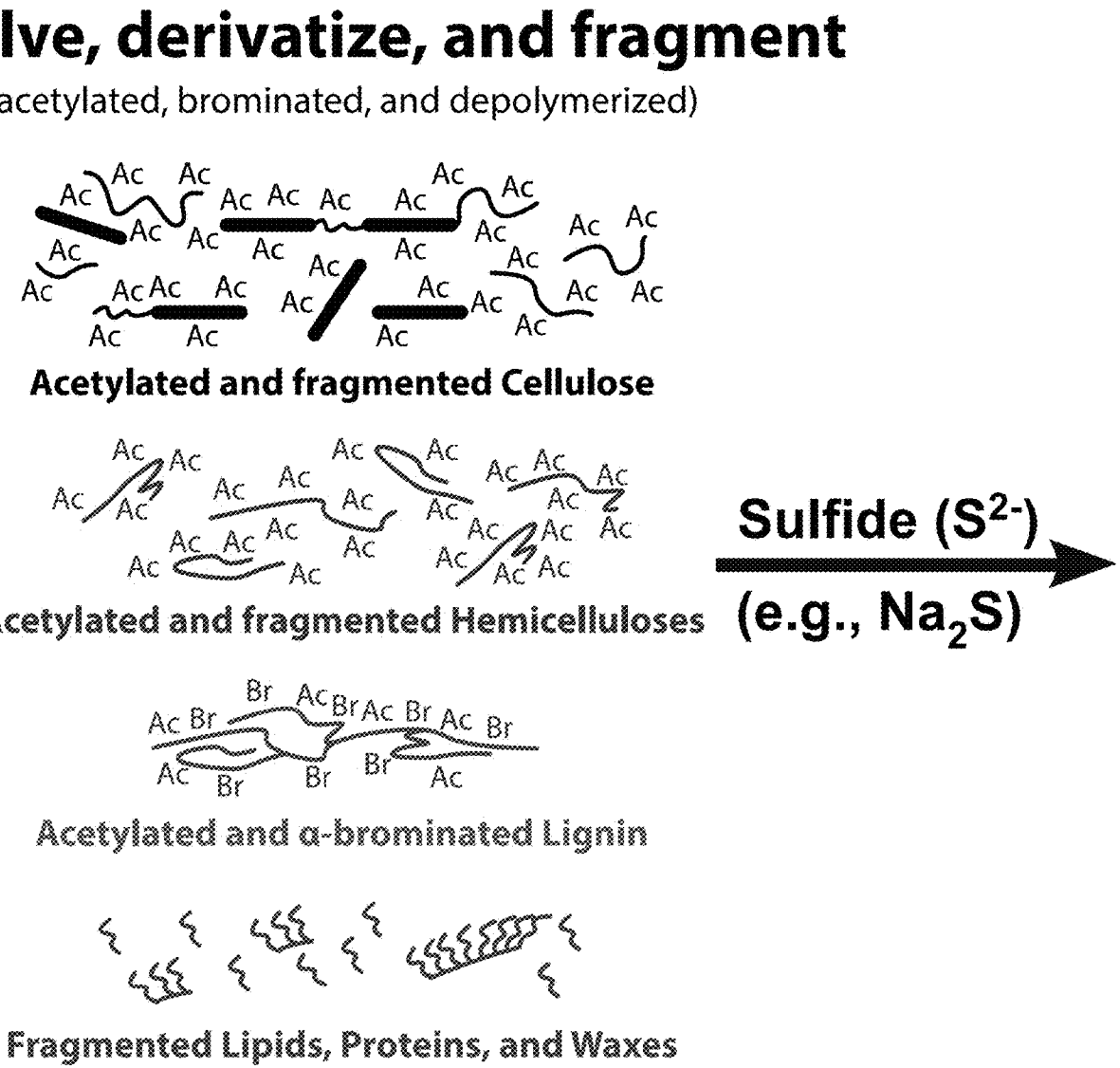

By way of a representative protocol for the method, and referring to FIGS. 1A. 1B, and 1C, the biomass (hardwoods, softwoods, grasses, etc.) is initially dissolved in an acidic solution containing an acyl halide at a temperature between roughly 20° C. and 100° C. See FIG. 1A. This solubilizes the biomass and derivatizes it to comprise partially fragmented, halogenated and acetylated lignins and other derivatized intermediates as shown in FIG. 1B (cellulose, hemicellulose, lipids, proteins, waxes, etc.)

Figure 1C:
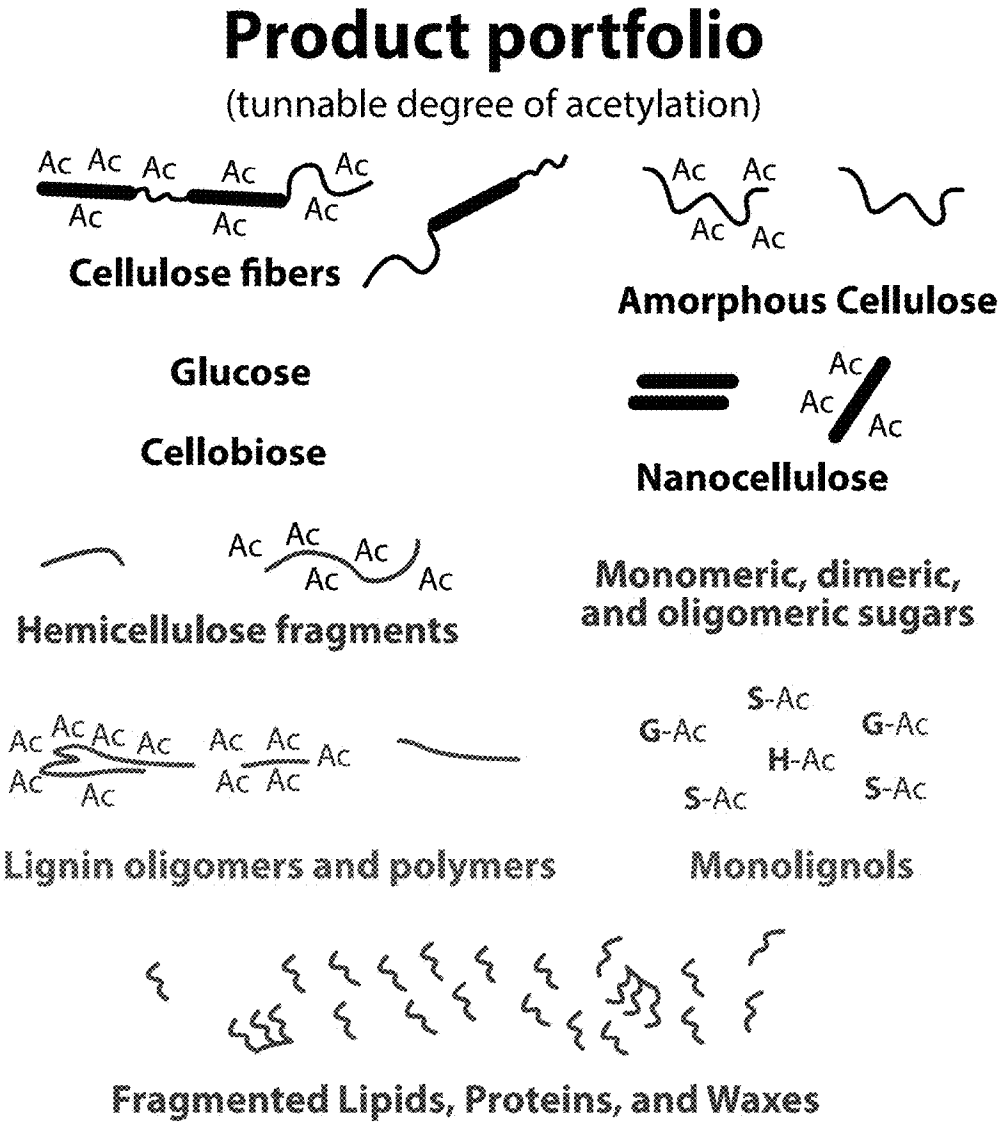

This intermediate is then treated, preferably in the same reaction vessel, with a reductant, preferably a sulfide, most preferably sodium and/or potassium sulfide. This yields a product mix in which some or all of the lignin has been degraded into lignin monomers or much smaller lignin oligomers. See FIG. 1C.

As noted, the reaction preferably takes place in an acidic solution. Other polar protic or polar aprotic solvents and mixtures thereof may also be used, such as ethers, cyclic ethers, alcohols, amides, and the like. Polar aprotic solvents include (but are not limited to) such well known solvents as acetone, N,N-dimethylformamide (DMF), acetonitrile, dimethylsulfoxide (DMSO), dioxane, and the like. Polar protic solvents, in addition to water, include methanol, ethanol, n-butanol, t-butanol, acetic acid, etc. Adjusting the solvent mixture and the pH of the reduction step alters the product distribution. It has generally been found that the polysaccharides found in the product mixture decrease in molecular weight with longer reaction times. The lignin fragments remain soluble after the reduction step.

Figure 2A:
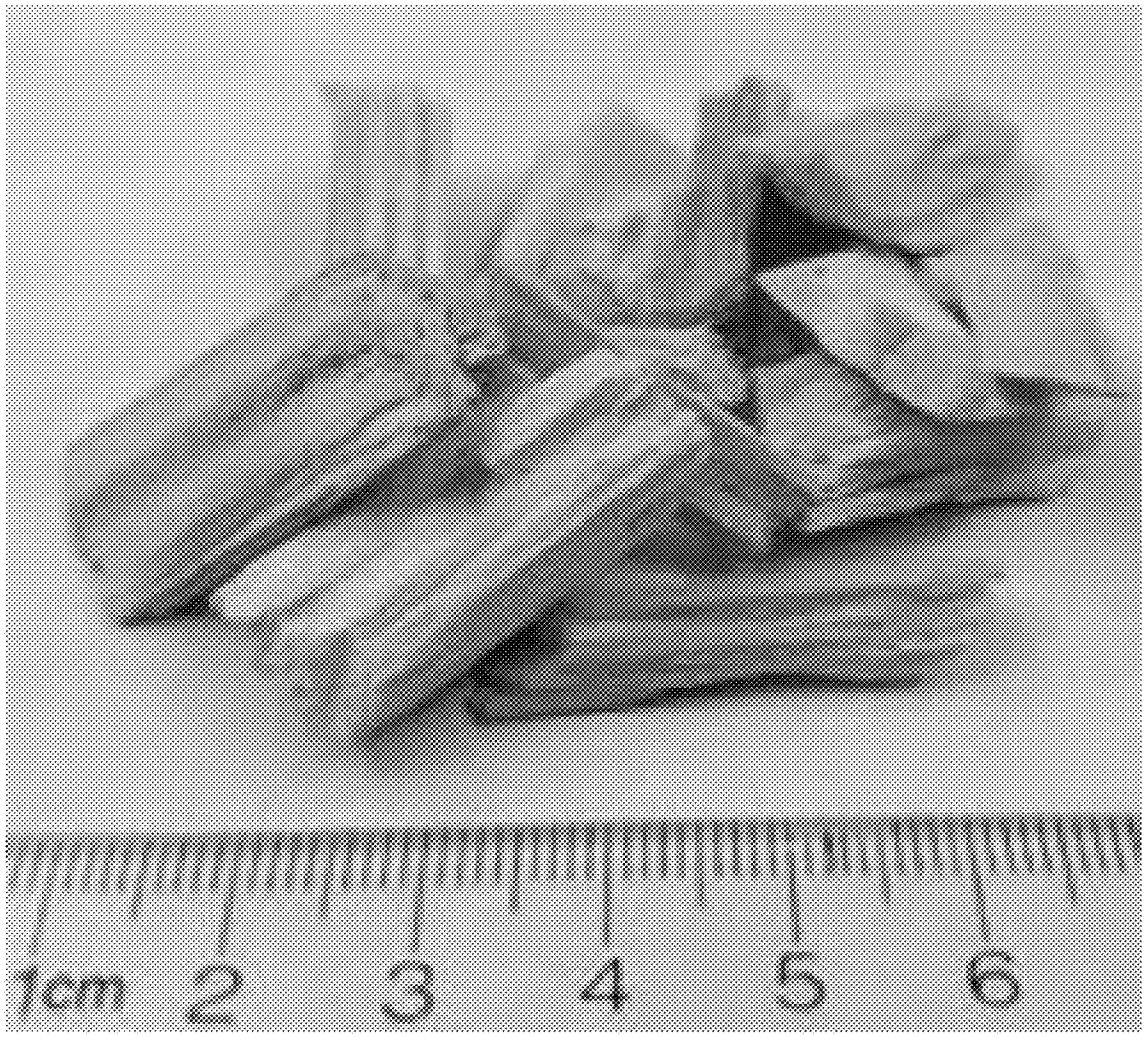
FIGS. 2A, 2B, 2C, and 2D constitute a series of photos showing, in step-wise fashion, an exemplary trial run of the method disclosed and claimed herein.

FIGS. 2A, 2B, 2C, and 2D present a series of photographs depicting the appearance of the feedstock and the intermediates at each step in the method. In FIG. 2A is depicted the typical feedstock—rough chipped biomass. As shown in FIG. 2A, this is simply rough-chipped lumber, but could be ground material (such as sawdust) or lignins already isolated via a prior pulping process, etc. As noted above, any biomass will do. The method works on isolated lignins, ground cell walls, and chipped material (without prior extraction).

Figure 2B:
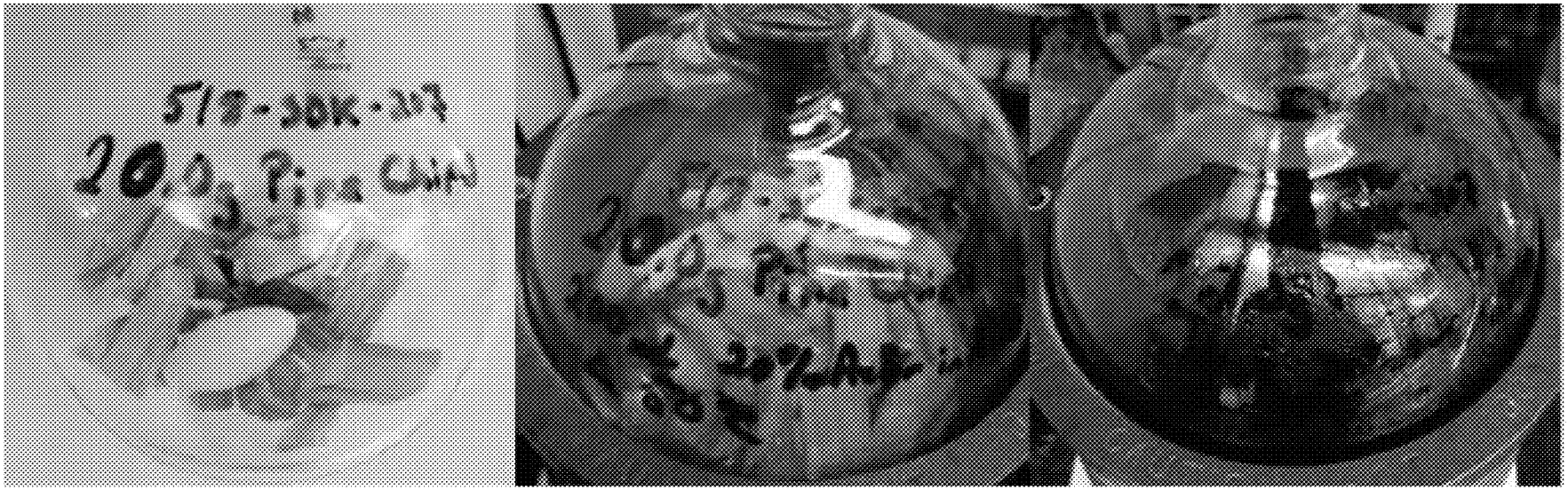

In FIG. 2B, the biomass has been liquefied in an acidic, aqueous solution containing acetic acid and acetyl bromide. The specific run shown in FIG. 2B was conducted at 50° C.

As described above, the reaction can be successfully performed at room temperature (e.g., 20° C.), although reaction times are longer.

Figure 2C:
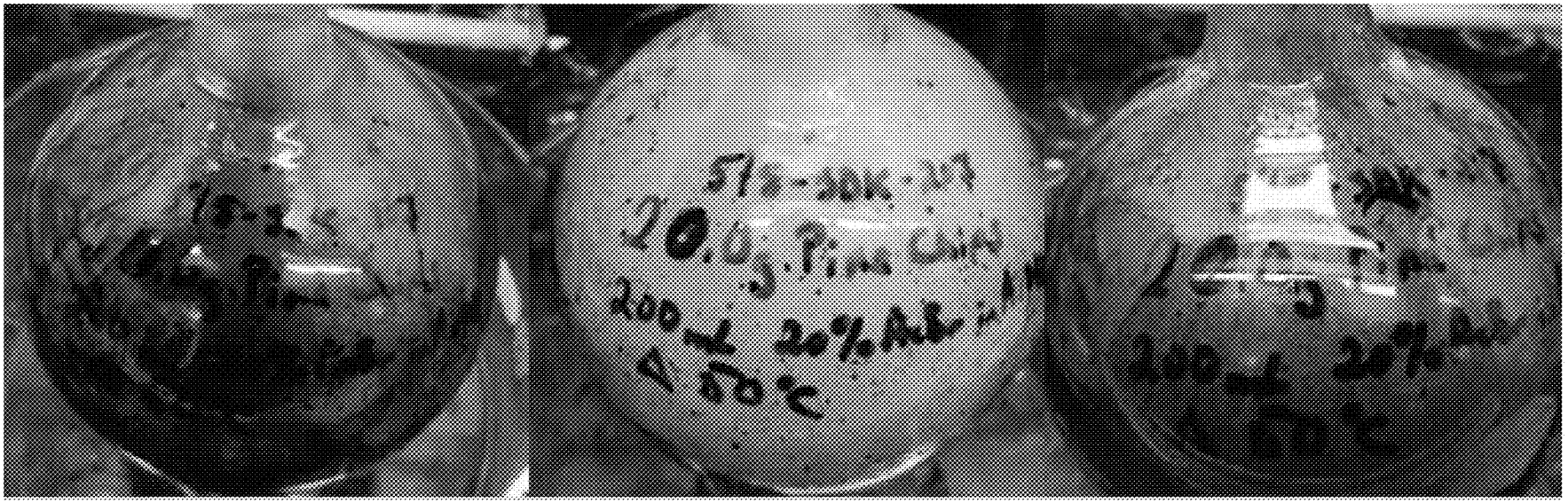
Figure 2D:
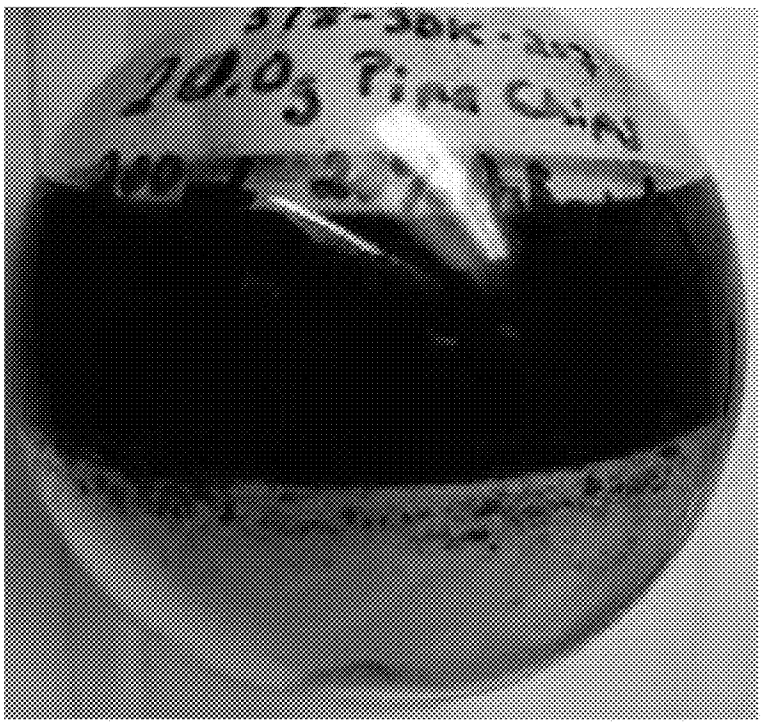

In FIG. 2C, after being solubilized in the acidic solution, the reaction is then subjected to reductive cleavage/fragmentation. As shown in FIG. 2C, this was accomplished by adding sodium sulfide directly to the reaction vessel in which the first step was conducted. The resulting product mixture was then extracted with ethyl acetate, as shown in FIG. 2D. The degraded lignin partitions into the ethyl acetate fraction (top), whereas sugars partition in the water fraction (bottom).

Figure 3:
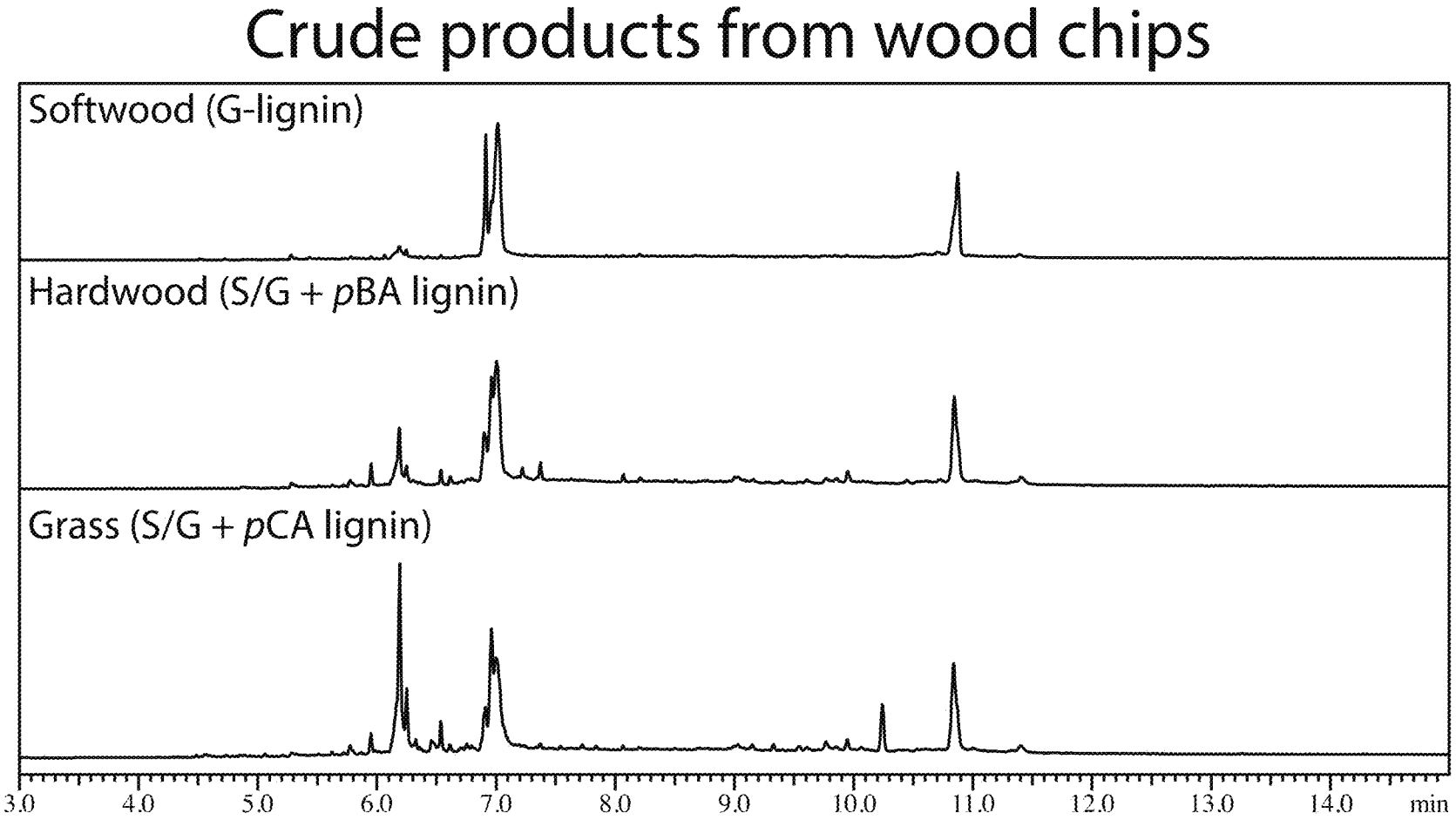
FIG. 3 depicts GC chromatograms of the ethyl acetate extractable crude product mixture from exemplary reactions according to the present method using as the reactant biomass softwood, hardwood, and grass. The GC chromatograms show that product mixes from all three reactions contain lignin and polysaccharide derived small molecules and oligomers.

Subjecting the ethyl acetate fraction to chromatography yielded the example chromatograms shown in FIG. 3. Here, the top trace was generated using a softwood (G-lignin) as the feedstock, which produces a simple product mixture. The middle trace of FIG. 3 was generated using a hardwood (S/G+pBA lignin) as the feedstock and revealed, as expected, a more complex distribution of products. The bottom trace of FIG. 3 was generated using a grass (S/G+pCA lignin) as the feedstock, producing the most complex product mixture of the three feedstocks.

GPC analysis of the ethyl acetate extractable crude product mixtures showed that they are composed primarily of small molecules, oligomers, and low molecular-weight polymers. This is consistent with fragmentation of the polymer chains by a combination of derivatization, reductive cleavage, and acid/base hydrolysis. See Table 1, which presents representative GPC data for runs using softwood, hardwood, and grass. The data presented in Table 1 was generated by using a first step reaction solution comprising acetic acid and acetyl bromide. After the first step, sodium sulfide was added to drive reductive cleavage of the solubilized biomass. The reaction was conducted at 50° C.

TABLE 1

Representative GPC Results

| Feedstock | Mw (kDa) | Mn (kDa) | Mp (kDa) | Polydispersity (Mw/Mn) |
|---|---|---|---|---|
| Softwood (Sitka spruce) | 9.9 | 0.8 | 0.7 | 13.167 |
| Hardwood (NM6 poplar) | 4.2 | 0.9 | 0.7 | 4.551 |
| Grass (W22 corn stover) | 2.7 | 0.7 | 0.7 | 3.583 |

Figure 4:
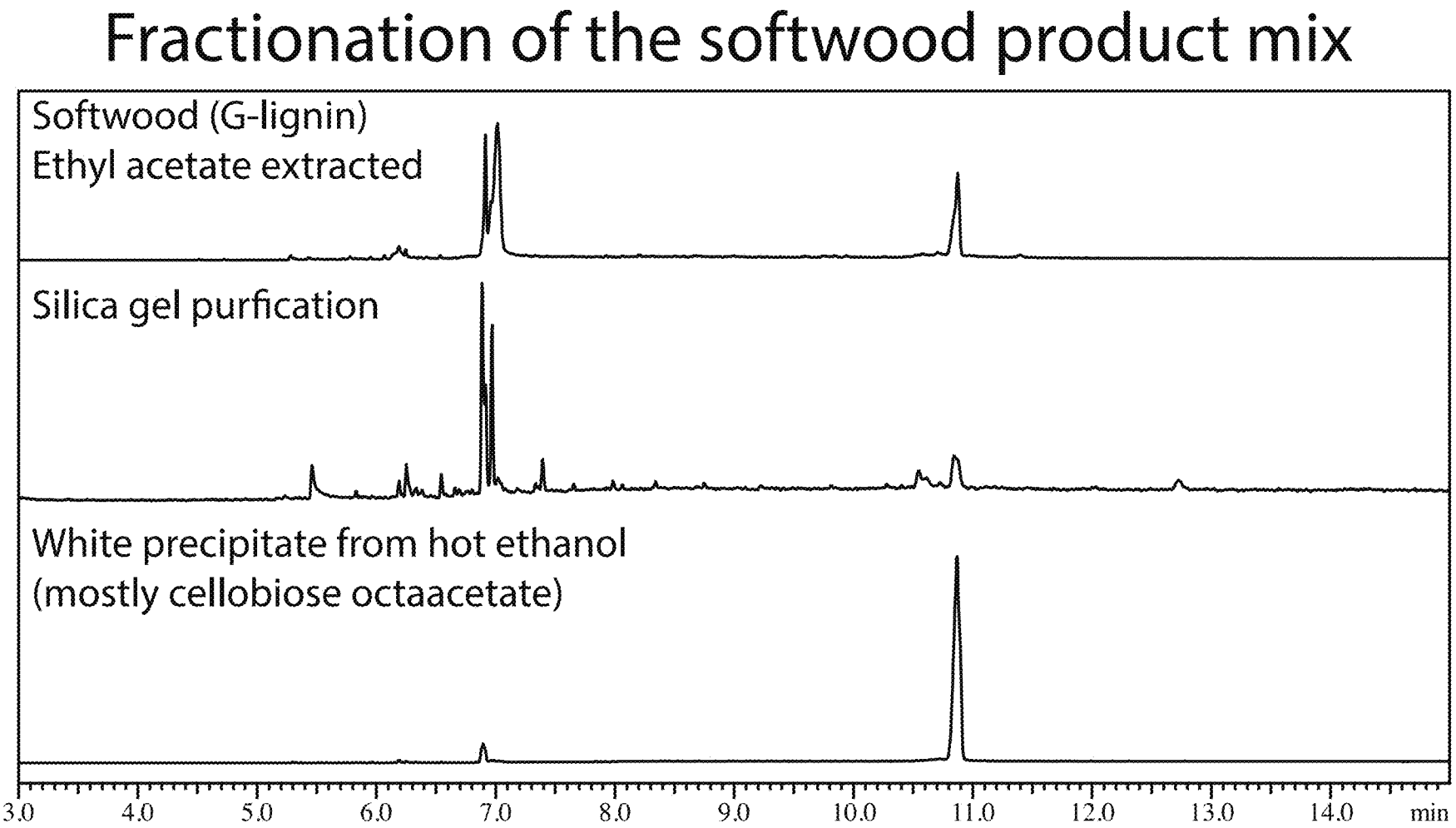
FIG. 4 depicts GC chromatograms of various fractions of the crude product mixtures analyzed in FIG. 3. The top trace is an ethyl acetate-extracted fraction. The middle trace is a fraction purified via silica gel chromatography. The bottom trace is from extraction and crystallization of the crude oil using hot-to-cold ethanol extraction.

After ethyl acetate extraction, the crude product mixture can be further fractionated by any number of methods, such as silica gel extraction or hot-to-cold ethanol extraction. See, for example FIG. 4. Here, representative chromatograms are presented for a representative run of the method using softwood as the feedstock, acetic acid/acetyl bromide in the first step, sodium sulfide in the second step, both steps conducted at 50° C. The top chromatogram of FIG. 4 shows the trace for the ethyl acetate-extracted crude product mix. Passing that fraction through silica-gel removed many of the polysaccharide and oligomeric components. See the middle trace of FIG. 4. Included in the fraction of the product mixture to elute from silica-gel was coniferyl diacetate. Extraction and crystallization of the crude product mixture using hot-to-cold ethanol yielded cellobiose octaacetate as a white precipitate. See the bottom chromatogram of FIG. 4.

Figure 5:
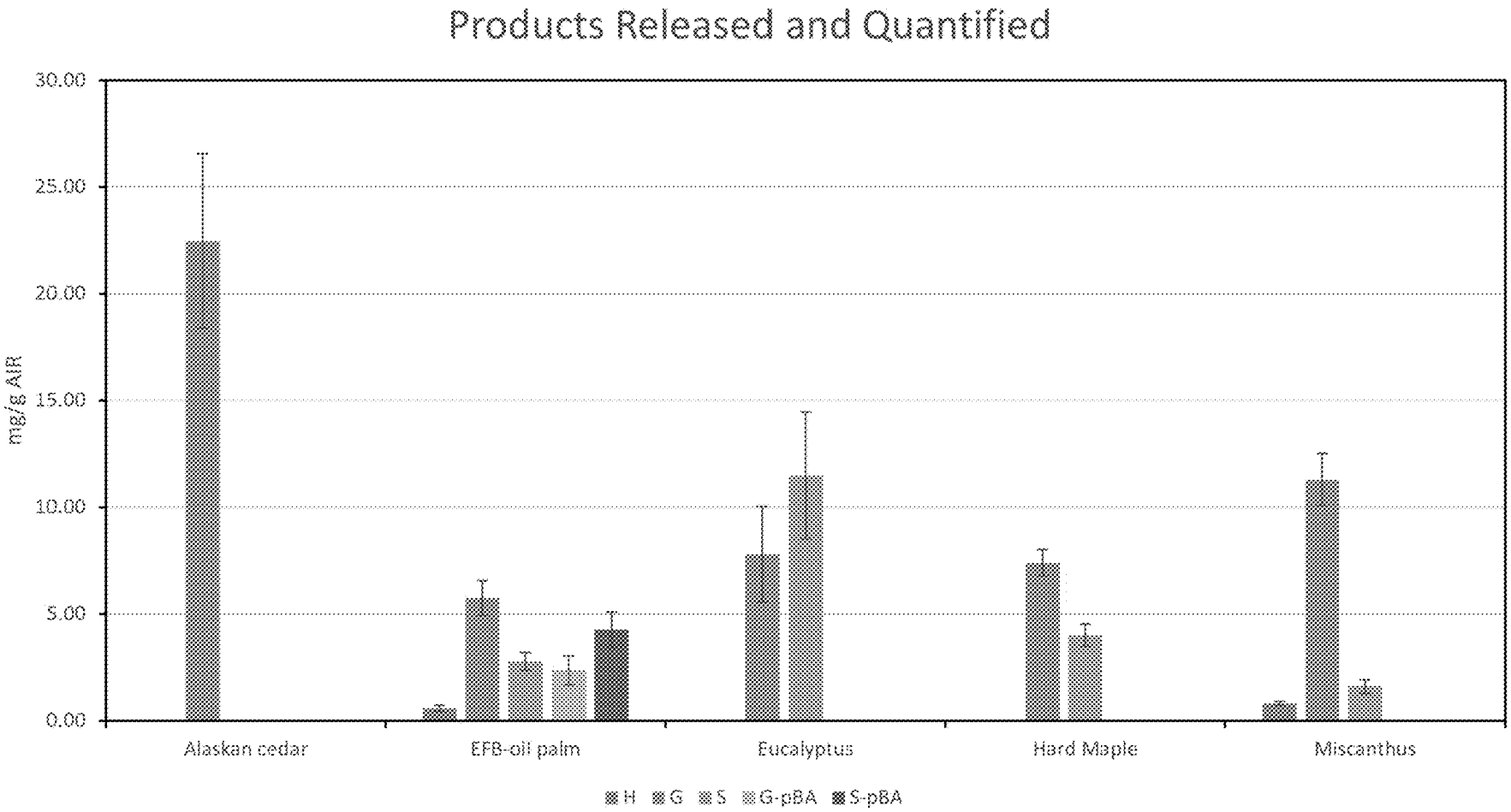
FIG. 5 depicts the amount of various lignin monomer products, in milligrams per gram of input raw biomass, produced from various species of plants.

When applied to other biomass sources, the monolignol and some monolignol conjugates are found in the portion of the product mixtures that elute from silica-gel in a mixture of hexanes and ethyl acetate (1:1, v/v). Table 2 expands the evidence that this method does not depend on the type of biomass by including plants that have S/G-lignin without acylation (mature wood from eucalyptus and hard maple), a second grass (*Miscanthus stover*) that is rich in S/G+pCA-lignin, and the empty fruit bunches of an oil palm that is another example of S/G+pBA-lignin from a very different type of tissue. See also FIG. 5, which presents this same data in histogram form.

TABLE 2

Product Mix using Various Biomass Feedstocks

| Biomass Source | Monomers mg/g | H mg/g | G mg/g | S mg/g | G-pBA mg/g | S-pBA mg/g |
|---|---|---|---|---|---|---|
| Alaskan cedar | 15.3 | 0.0 + 0.0 | 22.5 + 4.1 | — | — | — |
| oil palm (empty fruit bunches) | 11.4 | 0.6 + 0.1 | 5.8 + 0.8 | 2.8 + 0.4 | 2.4 + 0.7 | 4.3 + 0.8 |
| *Eucalyptus* | 12.9 | 0.0 + 0.0 | 7.8 + 2.2 | 11.5 + 3.0 | — | — |
| Hard maple | 7.7 | 0.0 + 0.0 | 7.4 + 0.6 | 4.0 + 0.5 | — | — |
| *Miscanthus* | 9.3 | 0.8 + 0.1 | 11.3 + 1.2 | 1.6 + 0.3 | — | — |

What is claimed is:

1. A method of liquefying biomass, the method comprising:

(a) contacting biomass with a solution comprising an acyl halide and an acid; and then (b) contacting the biomass with a reductant;

wherein the reductant of step (b) comprises a sulfide.

2. The method of claim 1, wherein the reductant of step (b) comprises an alkali metal sulfide salt.

3. The method of claim 1, wherein the reductant of step (b) comprises sodium sulfide and/or potassium sulfide.

4. The method of claim 1, wherein the reductant of step (b) comprises sodium sulfide.

5. The method of claim 1, wherein steps (a) and (b) are conducted at a temperature of about 100° C. or less.

6. The method of claim 1, wherein steps (a) and (b) are conducted at a temperature of about 75° C. or less.

7. The method of claim 1, wherein steps (a) and (b) are conducted at a temperature of about 50° C. or less.

8. The method of claim 1, wherein step (b) is conducted in the same reaction vessel as step (a) and the acyl halide used in step (a) is not removed from the vessel.

9. A method of liquefying biomass, the method comprising:

(a) contacting biomass with a solution comprising an acyl halide and a carboxylic acid; and then (b) contacting the biomass with a reductant.

10. The method of claim 9, wherein the reductant of step (b) comprises a sulfide.

11. The method of claim 9, wherein the reductant of step (b) comprises an alkali metal sulfide salt.

12. The method of claim 9, wherein the reductant of step (b) comprises sodium sulfide and/or potassium sulfide.

13. The method of claim 9, wherein the reductant of step (b) comprises sodium sulfide.

14. The method of claim 9, wherein steps (a) and (b) are conducted at a temperature of about 100° C. or less.

15. The method of claim 9, wherein steps (a) and (b) are conducted at a temperature of about 75° C. or less.

16. The method of claim 9, wherein steps (a) and (b) are conducted at a temperature of about 50° C. or less.

17. The method of claim 9, wherein step (b) is conducted in the same reaction vessel as step (a) and the acyl halide used in step (a) is not removed from the vessel.

18. A method of liquefying biomass, the method comprising:

(a) contacting biomass with a solution comprising an acyl bromide and a carboxylic acid; and then (b) contacting the biomass with a reductant.

19. The method of claim 18, wherein the reductant of step (b) comprises a sulfide.

20. The method of claim 18, wherein the reductant of step (b) comprises an alkali metal sulfide salt.

21. The method of claim 18, wherein the reductant of step (b) comprises sodium sulfide and/or potassium sulfide.

22. The method of claim 18, wherein the reductant of step (b) comprises sodium sulfide.

23. The method of claim 18, wherein steps (a) and (b) are conducted at a temperature of about 100° C. or less.

24. The method of claim 18, wherein steps (a) and (b) are conducted at a temperature of about 75° C. or less.

25. The method of claim 18, wherein steps (a) and (b) are conducted at a temperature of about 50° C. or less.

26. The method of claim 18, wherein step (b) is conducted in the same reaction vessel as step (a) and the acyl halide used in step (a) is not removed from the vessel.

27. A method of liquefying biomass, the method comprising:

(a) contacting biomass with a solution comprising acetyl bromide and acetic acid; and then (b) contacting the biomass with a reductant.

28. The method of claim 27, wherein the reductant of step (b) comprises a sulfide.

29. The method of claim 27, wherein the reductant of step (b) comprises an alkali metal sulfide salt.

30. The method of claim 27, wherein the reductant of step (b) comprises sodium sulfide and/or potassium sulfide.

31. The method of claim 27, wherein the reductant of step (b) comprises sodium sulfide.

32. The method of claim 27, wherein steps (a) and (b) are conducted at a temperature of about 100° C. or less.

33. The method of claim 27, wherein steps (a) and (b) are conducted at a temperature of about 75° C. or less.

34. The method of claim 27, wherein steps (a) and (b) are conducted at a temperature of about 50° C. or less.

35. The method of claim 27, wherein step (b) is conducted in the same reaction vessel as step (a) and the acyl halide used in step (a) is not removed from the vessel.

* * * * *